US006086047A

United States Patent [19]

Lee

[11] Patent Number: 6,086,047

[45] Date of Patent: Jul. 11, 2000

[54] HYDRAULIC JACK

[76] Inventor: Steven Lee, 2nd Fl., No. 20, Keh-Chiang Rd., 13 Lin, Lan-Hsing Li, Shih-Lin Dist., Taipei, Taiwan

[21] Appl. No.: 09/348,508

[22] Filed: Jul. 7, 1999

[51] Int. Cl.[7] ..... B60P 1/48

[52] U.S. Cl. ..... 254/8 B; 254/2 B

[58] Field of Search ..... 254/2 B, 8 B

[56] References Cited

U.S. PATENT DOCUMENTS 3,664,635 5/1972 Kincaid ..... 254/8 B

FOREIGN PATENT DOCUMENTS 820300 4/1937 France ..... 254/2 B 243433 10/1944 Germany ..... 254/2 B 2856613 8/1979 Germany ..... 254/2 B

*Primary Examiner*—David A. Scherbel

*Assistant Examiner*—Daniel G. Shanley

*Attorney, Agent, or Firm*—Rosenberg, Klein & Lee

[57] ABSTRACT

A hydraulic jack is disclosed. The hydraulic jack has a bearing (16) provided under the hydraulic cylinder (30), such that the handle (40) is able to steer the hydraulic jack to any direction as required. A quick-release handle (50) connected with a control plate (43) communicating with the hydraulic cylinder (30) is provided beside the handle (40) so as to facilitate the release of the pressure built up in the hydraulic cylinder (30).

1 Claim, 6 Drawing Sheets

HYDRAULIC JACK

BACKGROUND OF THE INVENTION

1. Field of the Invention

The present invention relates to a hydraulic jack, and particularly to a hydraulic jack having a quick-release handle for releasing the hydraulic pressure in the cylinder and a pair of steering wheels rotatably mounted thereunder for moving the hydraulic jack sidewardly easily.

2. Description of Related Art

The main purpose of a jack is to elevate object upward so that users are able to work on the underside of the object. A conventional hydraulic jack is shown in FIG. 6. The hydraulic jack comprises a substantially U-shaped base (60) with a plurality of wheels (601) mounted thereunder, a hydraulic cylinder (61) securely received in the base (60), a handle (62) operatably and pivotally connected with the hydraulic cylinder (61), a release button (63) mounted beside the hydraulic cylinder (61) and in communication with the hydraulic cylinder (61), a piston rod (64) extendably connected with the hydraulic cylinder (61) and an elevator (65) pivotally connected with the base (60) and having a seat (66) mounted at the free end of the elevator (65).

When in use, the reciprocal up-and-down movement of the handle (62) will thus build up pressure in the hydraulic fluid in the hydraulic cylinder (61). The pressure of the hydraulic fluid will drive the piston rod (64) to extend outwardly. The extension of the piston rod (64) will drive the elevator (65) to elevate. An object (not shown) seated on the seat (66) will thus be elevated. However, when the hydraulic jack of this type is not in use and the work on the object is finished, the user will have to disassemble the handle (62) from the hydraulic cylinder (61) and use the fork-like end of the handle (62) to rotate the release button (63) to release the pressure in the hydraulic cylinder (61), which is very troublesome for the user.

Furthermore, it is noted that by means of the wheels (601), the hydraulic jack is able to move in linear direction. However, when the hydraulic jack of the type is about to turn to another direction, the user will have to lift up one side of the jack and move to the desired direction, which is ineffective in use of the jack and labor costly.

Therefore, it is an objective of the invention to provide an improved hydraulic jack to mitigate and/or obviate the aforementioned problems.

SUMMARY OF THE INVENTION

The main objective of the invention is to provide an improved hydraulic jack which has a quick release handle mounted beside the handle, so that the user is able to release the pressure built up in the hydraulic cylinder.

Another objective of the invention is to provide a hydraulic jack which is able to move to any desired direction as required.

Other objects, advantages and novel features of the invention will become more apparent from the following detailed description when taken in conjunction with the accompanying drawings.

DETAILED DESCRIPTION OF PREFERRED EMBODIMENT

Figure 1:
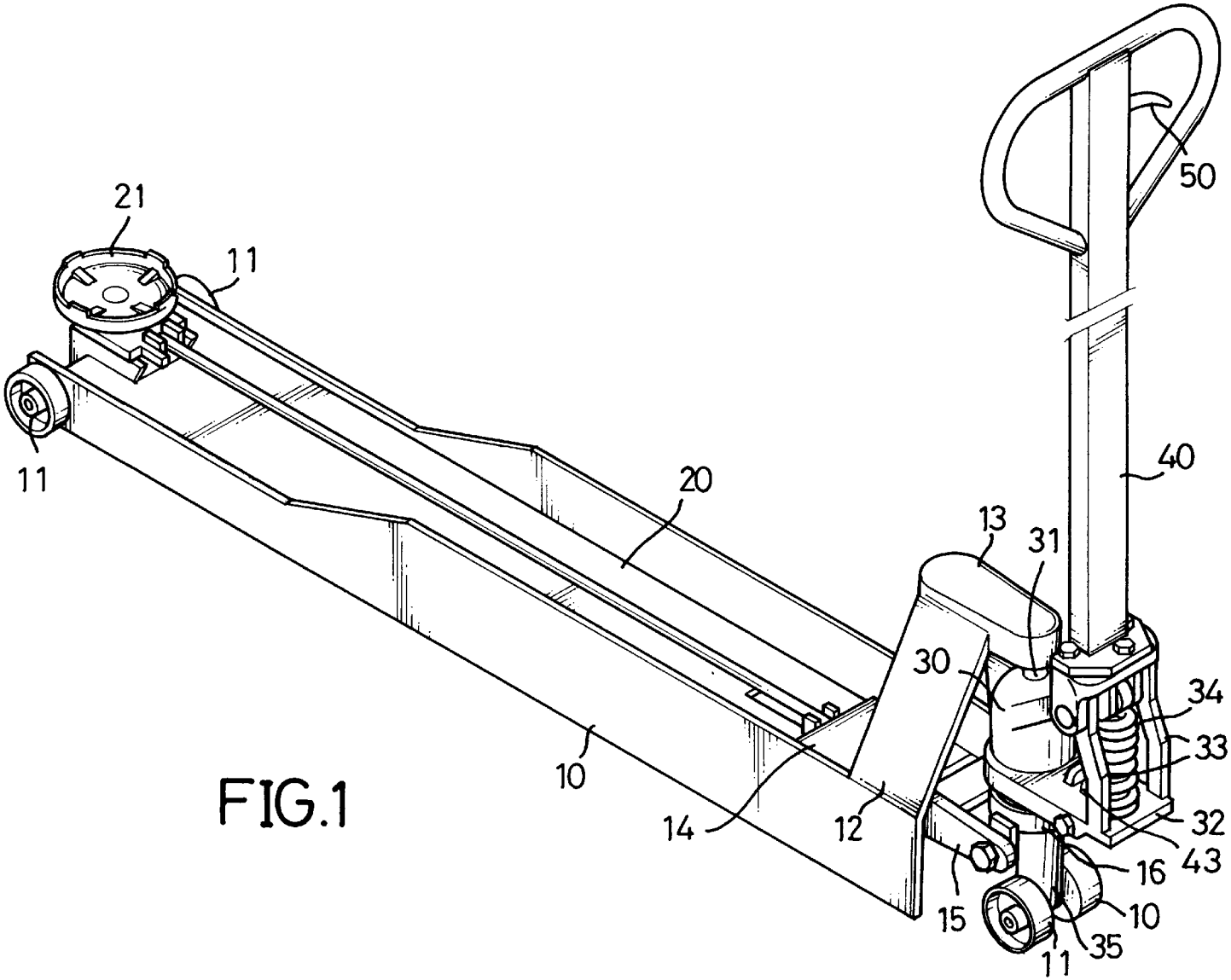
FIG. 1 is a perspective view of a hydraulic jack in accordance with the invention.

Referring to FIG. 1, it is noted that a hydraulic jack constructed in accordance with the invention has a substantially U-shaped base (10) with a plurality of wheels (11) rotatably mounted under the base (10), an elevator (20) pivotally mounted in relation with the base (10), a hydraulic cylinder (30) mounted at a first end of the base (10), a handle (40) pivotally mounted at the first end of the base (10) and a quick-release handle (50) pivotally mounted beside the handle (40).

The base (10), beside the wheels (11), has a bracket (12) securely mounted (preferably formed therewith) at one end thereof, an extension (13) integrally formed on top of the bracket (12), a plate (14) securely mounted across the base (10), two protrusions (15) respectively and extending in parallel from one side of the plate (14) and a bearing (16) securely mounted between the two protrusions (15).

The elevator (20) has a seat (21) mounted thereon and at the second end of the base (10). The hydraulic cylinder (30) has a piston rod (31) mounted under the extension (13), a support (32) securely mounted on top of the bearing (16), two rods (33) integrally formed on a top face of the support (32) and a spring (34) compressibly mounted between the two rods (33).

Figure 2:
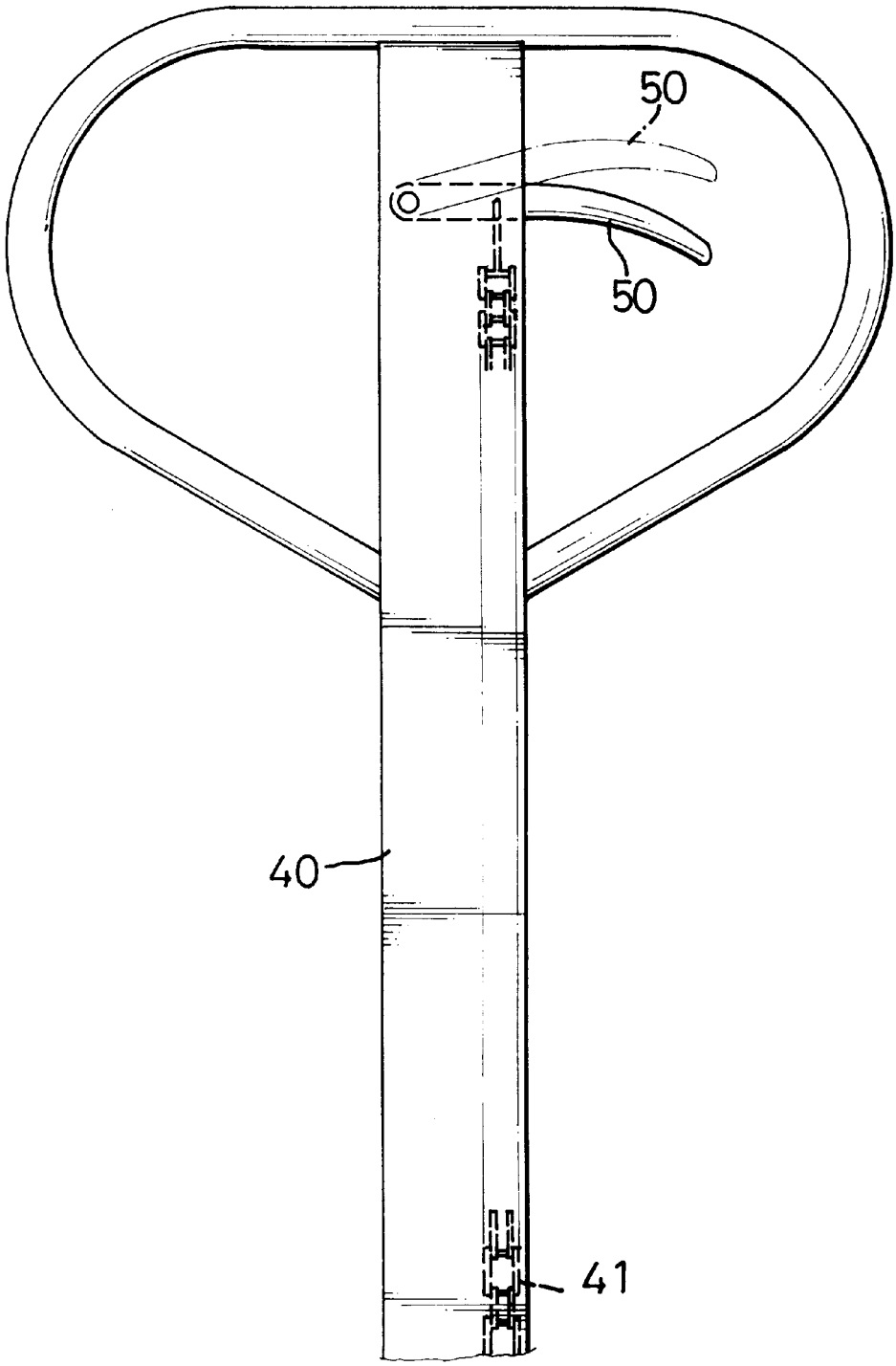
FIG. 2 is a plan view showing a quick-release handle being mounted along the handle of the hydraulic jack of the invention.
Figure 3:
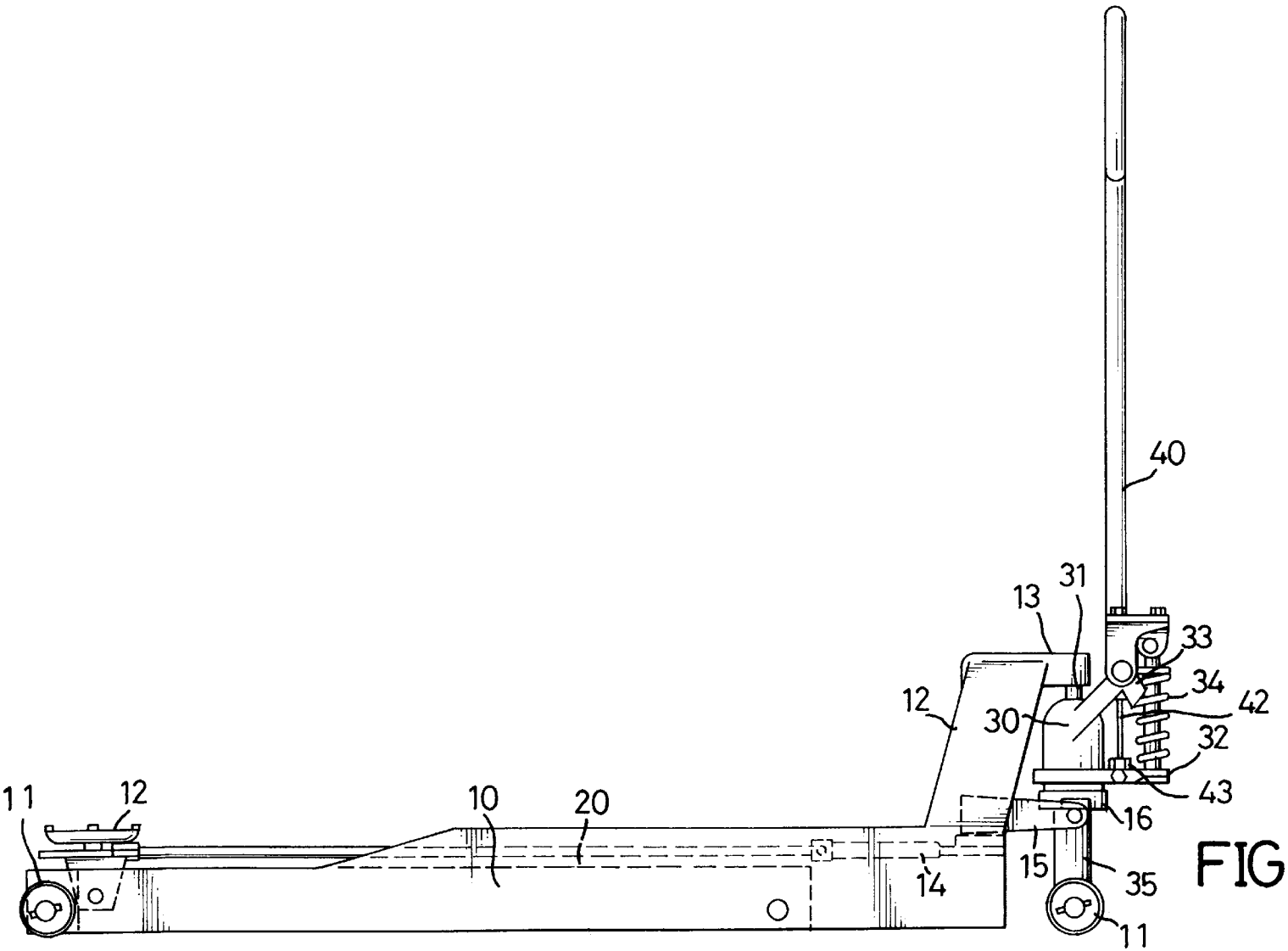
FIG. 3 is a side plan view showing the relationship between the quick-release handle and the hydraulic cylinder.

Referring to FIGS. 2 and 3, the quick-release handle (50) which is pivotally mounted beside the handle (40) is connected with a chain (41) movably received in the handle (40). The free end of the chain (41) is then connected with a link (42) and the link (42) in turn is connected with a control plate (43). The control plate (43) when being driven by the link (42) will become oblique with respect to the support (32). When the control plate (43) applies a force to the support (32), the pressure in the hydraulic fluid in the hydraulic cylinder (31) will be released.

Figure 4:
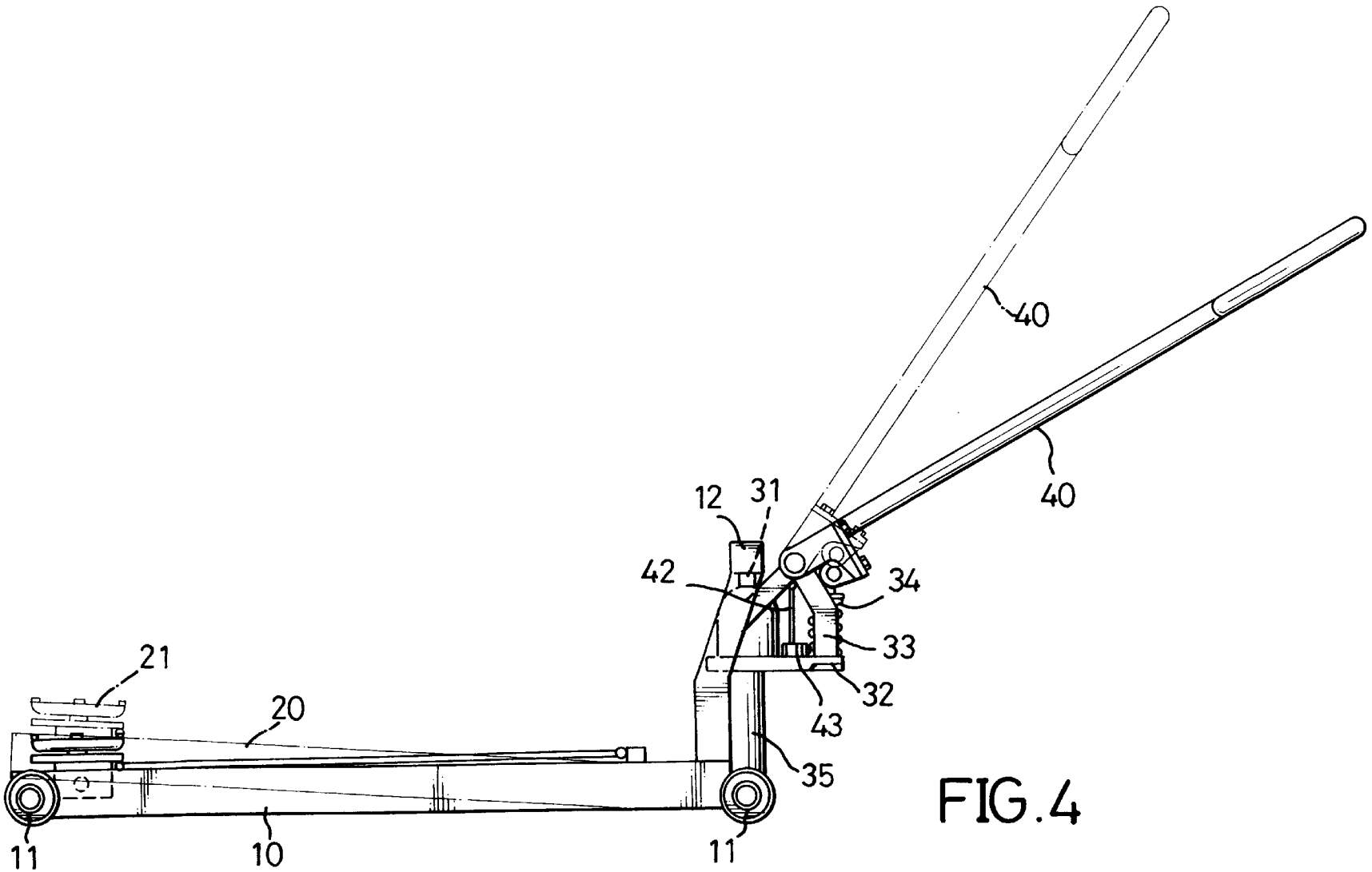
FIG. 4 is a side plan view showing the pressure being built up in the hydraulic cylinder and the driven of an elevator by the pressure.

FIG. 4 shows the reciprocal up-and-down movement of the handle (40) will elevate the elevator (20) and the seat (21) will then be able to lift an object (not shown) seated thereon.

Figure 5:
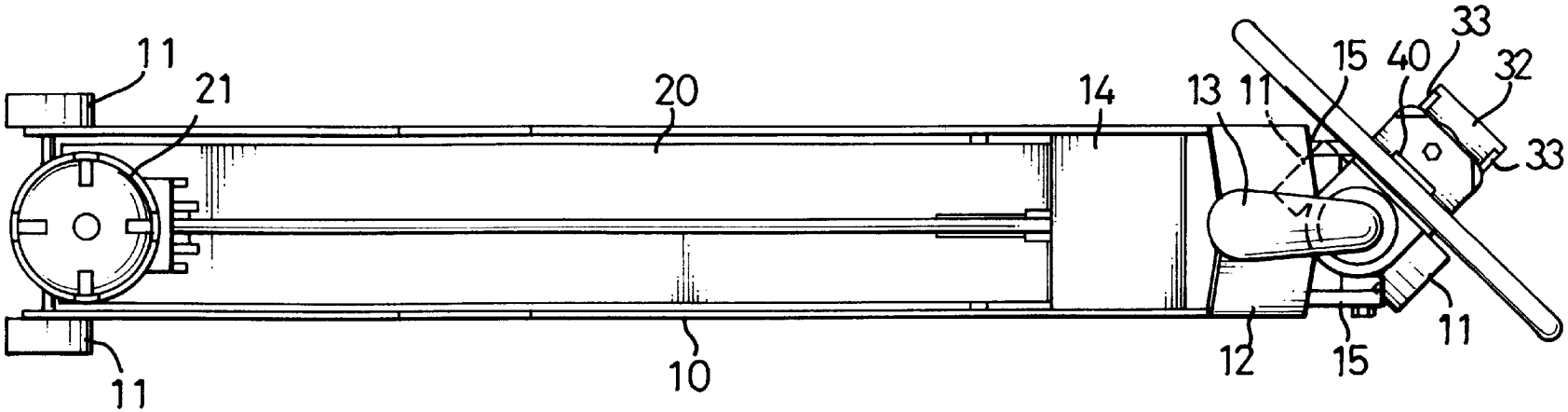
FIG. 5 is a top plan view showing the turning of the hydraulic jack of the invention.
Figure 6:
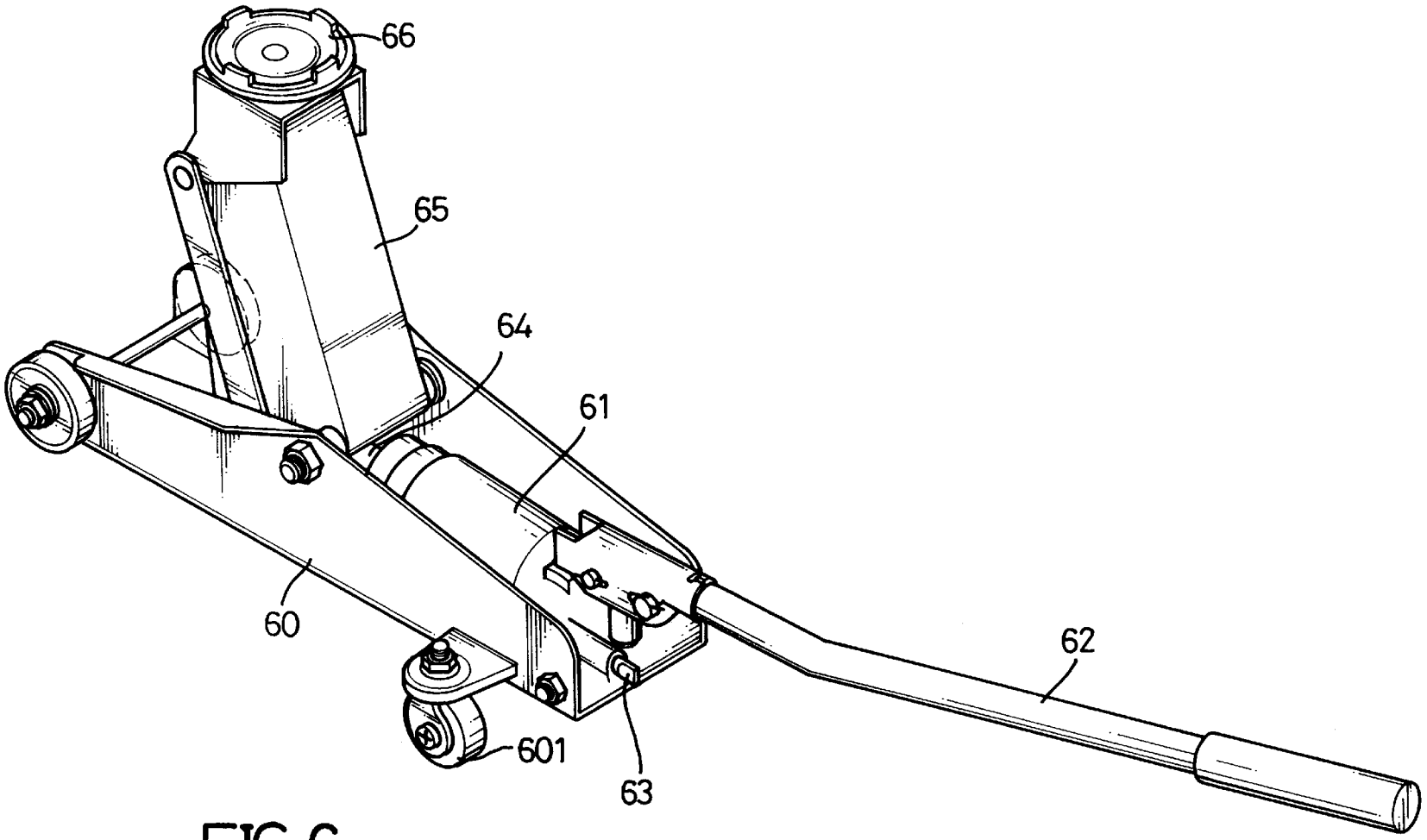
FIG.6 PRIOR ART
FIG. 6 is a perspective view showing the structure of a conventional hydraulic jack.

Referring to FIG. 5 and taking FIG. 4 for reference, the hydraulic cylinder (31) further has a shaft (35) extending downward therefrom and through the bearing (16). Because the handle (40), the support (32), the hydraulic cylinder (31) and the shaft (35) are securely connected with each other and especially the shaft (35) and the support (32) are practically formed into one piece, rotating the handle (40) will thus drive the shaft (35) to rotate simultaneously. Therefore, the turning of the hydraulic jack of the invention is convenient.

From the above description, it is noted that the invention has the following advantages:

1. simple structure:

The structure of the hydraulic jack is practically the same as the prior art, yet the use thereof becomes more convenient and more effective.

2. labor efficient:

Because the quick-release handle and the shaft together with the bearing, a lot of labor work is saved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hydraulic jack comprising:

a substantially U-shaped base (10) having an extension (13) formed adjacent a first end of the base (10), said base including a plurality of first wheels (11) rotatably mounted thereunder and a bearing (16) securely coupled thereto adjacent the first end of the base (10);

an elevator (20) pivotally mounted to the base (10) and having a seat (21) mounted at one end thereof disposed adjacent a second end of the base (10);

a hydraulic cylinder (30) mounted at the first end of the base (10) and having a piston rod (31) mounted under the extension (13), a control plate (43) for controlling release of pressure in the hydraulic cylinder (30), a support (32) coupled to the hydraulic cylinder and securely mounted on top of the bearing (16), two rods (33) integrally formed on a top face of the support (32), a spring (34) compressibly mounted between the two rods (33), and a shaft (35) extending from the support (32) and passing through the bearing (16) of the base (10) and having a plurality of second wheels (11) rotatable mounted thereon, the shaft (35) being pivotable to steer the steer the hydraulic jack;

a handle (40) pivotally mounted at the first end of the base (10) and coupled to the hydraulic cylinder (30) for building up pressure in the hydraulic cylinder (30) and pivoting the shaft (35) to steer the hydraulic jack;

a link (42) coupled to the control plate (43);

a quick-release handle (50) pivotally mounted to the handle (40); and, a chain (41) extending through the handle (40) coupled on one end to the quick-release handle (50) and an opposing end to the link (42) for displacing the control plate (43) and thereby releasing pressure in the hydraulic cylinder (30) responsive to displacement of the quick-release handle (50) relative to the handle (40).

* * * * *